US010906344B2

(12) United States Patent
Nagoshi et al.

(10) Patent No.: US 10,906,344 B2
(45) Date of Patent: Feb. 2, 2021

(54) PRINTING PAPER

(71) Applicant: MITSUBISHI PAPER MILLS LIMITED, Tokyo (JP)

(72) Inventors: Masanori Nagoshi, Tokyo (JP); Tetsuya Nishi, Tokyo (JP); Toru Kaneko, Tokyo (JP); Hideki Takada, Tokyo (JP); Masayuki Takishiro, Tokyo (JP)

(73) Assignee: MITSUBISHI PAPER MILLS LIMITED, Tokyo (JP)

( * ) Notice: Subject to any disclaimer, the term of this patent is extended or adjusted under 35 U.S.C. 154(b) by 0 days.

(21) Appl. No.: 16/603,777

(22) PCT Filed: Mar. 12, 2018

(86) PCT No.: PCT/JP2018/009582
§ 371 (c)(1),
(2) Date: Oct. 8, 2019

(87) PCT Pub. No.: WO2018/203444
PCT Pub. Date: Nov. 8, 2018

(65) Prior Publication Data

US 2020/0114674 A1 Apr. 16, 2020

(30) Foreign Application Priority Data

May 2, 2017 (JP) ..... 2017-091699
May 2, 2017 (JP) ..... 2017-091703
May 2, 2017 (JP) ..... 2017-091704

(51) Int. Cl.
*B41M 5/52* (2006.01)
*B41J 2/01* (2006.01)
(Continued)

(52) U.S. Cl.
CPC ..... *B41M 5/5218* (2013.01); *B41M 5/5254* (2013.01); *B41J 2/01* (2013.01);
(Continued)

(58) Field of Classification Search
CPC ..... B41M 5/50; B41M 5/52; B41M 5/502; B41M 5/508; B41M 5/4218; B41M 5/5254; B41M 5/5263
See application file for complete search history.

(56) References Cited

U.S. PATENT DOCUMENTS

2005/0260428 A1 11/2005 Song et al.
2012/0107531 A1* 5/2012 Idei et al. ..... B41M 5/508

FOREIGN PATENT DOCUMENTS

JP 2006-233371 A 9/2006
JP 2007-216664 A 8/2007
(Continued)

OTHER PUBLICATIONS

ISO 2813, "Paints and varnishes—Determination of specular gloss of non-metallic paint films at 20°, 60° and 85°," International Standard, Aug. 1, 1994, 13 pages.
(Continued)

*Primary Examiner* — Juanita D Jackson
(74) *Attorney, Agent, or Firm* — Birch, Stewart, Kolasch & Birch, LLP

(57) ABSTRACT

A printing paper having a base paper and an outermost coating layer is provided, and satisfies at least one of the following characteristics (I), (II) and (III): (I) when an aqueous solution having a surface tension of 20 mN/m is dropped on the side having the outermost coating layer of the printing paper, a contact angle between the droplet and the outermost coating layer is 40° or more and 65° or less; (II) for the side having the outermost coating layer of the printing paper, a transfer amount of an aqueous solution
(Continued)

having a surface tension of 20 mN/m at a contact time of 1 second as determined by the Bristow method is 5.0 ml/$m^2$ or more and 12.0 ml/$m^2$ or less; and (III) on the surface of the outermost coating layer of the printing paper, a maximum peak value of specular reflection light quantity of a point image is 2,000 or more and 30,000 or less.

5 Claims, 1 Drawing Sheet

(51) Int. Cl.
*B41M 5/50* (2006.01)
*D21H 19/38* (2006.01)

(52) U.S. Cl.
CPC ..... *B41M 5/502* (2013.01); *B41M 5/5245* (2013.01); *D21H 19/385* (2013.01)

(56) References Cited

FOREIGN PATENT DOCUMENTS

| | | | |
|---|---|---|---|
| JP | 2011-148194 | A | 8/2011 |
| JP | 5204723 | B2 | 6/2013 |
| JP | 2013-163873 | A | 8/2013 |
| JP | 2014-205270 | A | 10/2014 |
| JP | 2017-13261 | A | 1/2017 |
| JP | 2018-15943 | A | 2/2018 |

OTHER PUBLICATIONS

ISO 8254-1, "Paper and board—Measurement of specular gloss—Part 1: 75° gloss with a converging beam, TAPPI method," International Standard, Nov. 1, 1999, 14 pages.
JIS K7374:2007, "Plastics—Determination of image clarity," 2012, pp. 987-991.

* cited by examiner

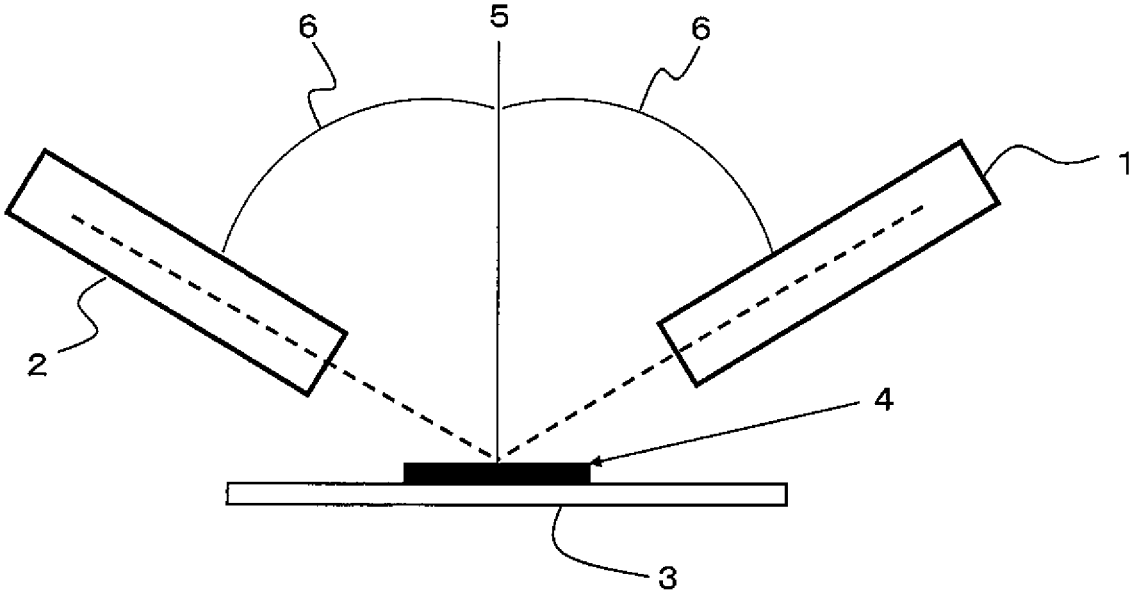
6
5
6
1
2
4
3

PRINTING PAPER

TECHNICAL FIELD

The present invention relates to a printing paper for an offset printing press while capable of printing with an inkjet printing press.

BACKGROUND ART

Inkjet recording system is a system in which ink droplets are ejected from fine nozzles onto a recording paper and deposited on the paper to form ink dots for recording.

The inkjet recording system is used for small printers for home and small office/home office (SOHO), wide format printers used for POP and poster production, and on-demand printing presses used for producing commercial printed materials. There are printing papers of various glossy ranging from matte tones to gross tones. The paper quality required is different from each other between printing paper for the production of commercial printed materials such as business documents, DM, books, brochures, flyers, pamphlets and catalogs, and photographic paper developed as alternatives of silver halide photos in the inkjet recording system in terms of cost of printed matter, printed productivity and handling of printed matter.

As on-demand inkjet printing paper which suppresses white streaks of an image due to poor diffusion of ink dots and has high print quality even at high speed printing using an on-demand inkjet printing press, on-demand inkjet printing paper is known that has, on at least one surface of a support, an ink-receiving layer which contains a pigment, a binder, a surfactant and a slight cationic polymer, in which the slight cationic polymer has the cationization degree of more than 0 meq/g and 3.00 meq/g or less, and the contact angle between the droplet and the ink-receiving layer 0.1 second after the dropping is within the range of 10° to 40° when a liquid having a surface tension of 25 mN/m is dropped onto the ink-receiving layer in accordance with Wilhelmy-plate method (e.g., see Patent Document 1).

For a recording ink, a recording media, an ink media set and an ink recorded material capable of recording a high quality image by inkjet recording system close to commercial printing such as offset printing, and an inkjet recording method and an inkjet recording apparatus, an ink media set is known that has an ink and a recording medium, in which the ink contains at least water, a coloring agent and an wetting agent, and has surface tension of 20 mN/m to 35 mN/m at 25° C., and the recording medium has a support and a coating layer on at least one surface of the support, and the transfer amount of the ink to the recording medium at the contact time of 100 ms is 4 $ml/m^2$ to 15 $ml/m^2$, and the transfer amount of the ink to the recording medium at the contact time of 400 ms is 7 $ml/m^2$ to 20 $ml/m^2$, measured by dynamic scanning absorptometer (e.g., see Patent Document 2).

Plate printing presses such as an offset printing press and a letterpress printing press require a "plate" on which printing image has been formed. On the other hand, an on-demand printing press does not need a "plate". That is, in the on-demand printing press, an image-forming apparatus prints directly on the printing paper according to digital information regarding image.

There is an on-demand printing press that uses inkjet recording system, i.e., an inkjet recording press. Examples of the inkjet recording press include Truepress Jet manufactured by SCREEN Graphic and Precision Solutions Co., Ltd., the MJP Series manufactured by Miyakoshi Printing Machinery Co., Ltd., Prosper and VERSAMARK manufactured by Eastman Kodak Company, JetPress manufactured by Fujifilm Corp., and Color Inkjet Web Press manufactured by Hewlett Packard.

These inkjet printing presses have color printing speeds that are ten to several tens of times faster than inkjet printers for home and small office/home office (SOHO) use as well as wide format inkjet printers, and the inkjet printing presses operate at printing speeds of 15 m/min or higher and exceeding 100 m/min in the case of high-speed printing, depending on various printing conditions. Because of this, inkjet printing presses are distinguished from inkjet printers for home and SOHO use and wide format inkjet printers.

Light incident on the paper is reflected on the surface of the paper, and scattered, reflected or absorbed inside the paper. Such reflection, scattering and absorption of light is a physical phenomenon occurring in paper. On printing paper, the reflection of light influences the sharpness, texture and glossiness of the image which the human being feels. In particular, reflection of light has a strong influence on printing paper having a coating layer.

The reflection occurring on the surface of the paper includes specular reflection. The specular reflection is the reflection of light which performs incident and light reception at the same angle from the normal direction of the sample surface to the opposite side, respectively, and is also called regular reflection. Gloss is an attribute of visual perception mainly determined by the intensity of reflected light.

Attempts have been made in the past to evaluate human subjective gloss feelings using quantitative measurement values. For example, ISO 2813:1994 and ISO 8254-1:1999 are known as methods for measuring specular gloss, and JIS K 7374:2007 is known as a method for measuring image clarity (e.g., see Non-Patent Documents 1 to 3).

However, in the above method, it may not be possible sometimes to sufficiently evaluate the human subjective gloss feeling. As a method and a measuring apparatus for evaluating human subjective gloss feelings with quantitative measured values which could not be obtained by the above method, known are: a method for measuring specular reflection light distribution of point images, which comprises a step of generating parallel light by a collimator lens using a point image as a light source, a step of injecting the parallel light into a sample, a step of receiving specular reflection light of the parallel light incident on the sample, forming an image by a collimator lens and returning it to a point image, and a step of measuring the light quantity distribution of the imaged point image, and further comprises a step of calculating a variable angle light intensity and a deviation angle light intensity of the sample from the light quantity distribution of the measured imaged point image; and a an apparatus for measuring specular reflection light distribution of a point image, which comprises a means for generating parallel light by a collimator lens using a point image as a light source, a means for injecting the parallel light into a sample, a means for receiving specular reflection light of the parallel light incident on the sample, forming an image by a collimator lens and returning it to a point image, and a means for measuring the light quantity distribution of the imaged point image, and further comprises a means for calculating a variable angle light intensity and a deviation angle light intensity of the sample from the light quantity distribution of the measured imaged point image (e.g., see Patent Document 3).

In specular reflection light distribution measurement of a point image, when a point image is input to an optical system and the point image is expanded by comparing the output point image with the original point image, the image generally blurs.

PRIOR ART DOCUMENTS

Patent Documents

Patent Document 1: Japanese Patent Application Kokai Publication No. 2017-13261 (unexamined, published Japanese patent application)

Patent Document 2: Japanese Patent Application Kokai Publication No. 2007-216664 (unexamined, published Japanese patent application)

Patent Document 3: Japanese Patent Publication No. 5204723

Non-Patent Documents

Non-Patent Document 1: ISO2813:1994 "Paints and varnishes-Determination of specular gloss of non-metallic paint films at 20°, 60° and 85°"

Non-Patent Document 2: ISO8254-1:1999 "Paper and board—Measurement of specular gloss—Part1:75° gloss with a converging beam, TAPPI method"

Non-Patent Document 3: JIS K7374:2007 "Plastics—Determination of image clarity"

SUMMARY OF THE INVENTION

Problems to be Solved by the Invention

Due to the spread of on-demand printing presses, it is necessary for printing paper to be compatible with not only plate printing presses but also on-demand printing presses. In particular, it is necessary for printing paper to be applicable to an offset printing press and an inkjet printing press which are often used for the production of commercial printed materials.

In an offset printing press, ink adhering to a plate contacts with a printing paper via a blanket and is transferred to the printing paper to produce printed materials. The inkjet printing press ejects ink droplets onto a printing paper from fine nozzles that are not in contact with the paper to produce printed materials. Due to such a difference in printing mechanism, the ink of the offset printing press has adhesiveness and high concentration of coloring materials. The ink of the inkjet printing press has fluidity and low concentration of coloring materials.

Therefore, in order to solve the problem of realizing a printing paper which is suitable for an offset printing press and is capable of printing with an inkjet printing press, means to solve the following divided problems individually is desirable.

The First Problem is as Follows.

When conventional printing paper for offset printing presses is used in an inkjet printing press, there is a disadvantage that a strike-through in a printed portion and a dot diffusion failure in a printed portion occur. "Strike-through" is a phenomenon in which the ink reaches the deep portion of the base paper without stopping on the printed side surface, and the printing portion is visually recognized from the back side of the printed side surface. Commercial printed materials are often printed on both sides thereof, and the occurrence of strike-through lowers the value of commercial printed materials. "Dot diffusion failure" is a phenomenon in which spreading of ink droplets in the plane direction of paper is insufficient in the process of collision and absorption of ink on printing paper. For this reason, overlapping of dots formed by ink droplets becomes insufficient, ink drop-out occurs in the image portion, and white streaks occur in the paper conveyance direction. This is called "white streak" and it lowers the value of commercial printed materials.

The Second Problem is as Follows.

When conventional printing paper for offset printing presses is used in an inkjet printing press, partial variations occur in the ink absorbability of the printing paper as the printing speed increases, and in some cases the color density of the printed portion becomes non-uniform. The reason for this is that the ink of the inkjet printing press has fluidity and the concentration of the coloring material is low.

Also, as the printing speed increases, if receiving of the ink on the printing paper is not successful, the reproducibility of the dot may decrease in the printed portion. If the reproducibility of dots decreases, image quality deteriorates. This is because the paper conveyance speed increases in proportion to the high printing speed and the ink droplets adhering to the surface of the printing paper flow when the ink droplets land on the paper surface. That is, the dots formed by the ink droplets landed on the paper surface become distorted or the outline of the dot becomes unclear, causing deterioration in image quality.

Also, when the ink solvent contained in the ink of the inkjet printing press arrives at the base paper, cockling of the base paper may occur due to expansion and contraction of the fiber. The cockling occurred by the ink solvent causes a trouble of contact between the print head of the inkjet printing press and the paper, or a dimensional defect trouble at the time of processing after printing.

The Third Problem is as Follows.

When conventional printing paper for an offset printing press is used in an inkjet printing press, absorption of ink cannot follow the printing speed as printing speed increases, so printing stain may be generated in some cases. Also, it is sometimes difficult to recognize a printed portion composed of small characters of 5 points or less as characters. Generally, whether or not it can be recognized as a character is called visibility, and visibility represents the degree of ease of viewing characters. For example, for a blue character on green paper or a yellow character on white paper, visibility deteriorates.

It is considered that generation of printing stain or difficulty to recognize as characters is caused by a difference in printing method and ink between an offset printing press and an inkjet printing press.

As the printing speed increases, if the fixing of the ink on the printing paper is insufficient, the ink may be peeled off when the printed material is rubbed with hands. Commercial printed materials such as posters, booklets, catalogs, POP, DM and fryers are often touched with hands and it is important that ink is not peeled off.

An object of the present invention is to provide a printing paper having the following quality for an inkjet printing press, aiming to be able to print with an inkjet printing press even though it is a printing paper suitable for an offset printing press.

In response to the first problem, an object of the present invention is to provide a printing paper having the following qualities:

(1) excellent color development of printed portions (color development property);

(2) suppression of strike-through of printed portions (resistance to strike-through); and (3) suppression of poor dot diffusion of printed portions (resistance to poor dot diffusion).

In response to the second problem, an object of the present invention is to provide a printing paper having the following qualities:

(4) uniform color density of the printed portions (color density uniformity);

(5) excellent reproducibility of dots in printed portions (dot reproducibility); and (6) suppression of cockling of printed portions (resistance to cockling).

In response to the third problem, an object of the present invention is to provide a printing paper having the following qualities:

(7) suppression of printing stain (resistance to printing stain);

(8) excellent visibility of small characters (character visibility); and (9) suppression of peeling of ink at the printed portion (scratch resistance).

Means for Solving the Problems

As a result of intensive study by the present inventors, the objects of the present invention can be achieved by the following items.

[1] A printing paper having a base paper, and one or more coating layer(s) arranged on at least one surface of the base paper, wherein, in the coating layer(s), an outermost coating layer positioned on the outermost side with respect to the base paper contains at least a pigment, a binder, a lubricant, a dispersant and a cationic resin, wherein the pigment in the outermost coating layer contains kaolin and calcium carbonate, a content of the kaolin and the calcium carbonate is 80 parts by mass or more based on 100 parts by mass of the pigment in the outermost coating layer, and a mass content ratio of the kaolin to the calcium carbonate in the outermost coating layer is 1:9 to 6:4, and the printing paper satisfies at least one of the following characteristics (I), (II) and (III):

(I) when an aqueous solution having a surface tension of 20 mN/m is dropped on the side having the outermost coating layer of the printing paper, a contact angle between the droplet and the outermost coating layer is 40° or more and 65° or less;

(II) for the side having the outermost coating layer of the printing paper, a transfer amount of an aqueous solution having a surface tension of 20 mN/m at a contact time of 1 second as determined by the Bristow method is 5.0 ml/m$^2$ or more and 12.0 ml/m$^2$ or less; and (III) on the surface of the outermost coating layer of the printing paper, a maximum peak value of specular reflection light quantity of a point image is 2,000 or more and 30,000 or less.

According to the above [1], while the printing paper has suitability for an offset printing press, the printing paper can, with respect to an inkjet printing press, have the qualities of color development property, resistance to strike-through and resistance to poor dot diffusion, which are the first object, by satisfying the characteristic (I), have the qualities of color density uniformity, dot reproducibility and resistance to cockling, which are the second object, by satisfying the characteristic (II), and have the qualities of resistance to printing stain, character visibility and scratch resistance, which are the third object, by satisfying the characteristic (III).

[2] The printing paper according to [1] above, having a base paper, and one or more coating layer(s) arranged on at least one surface of the base paper, wherein, in the coating layer(s), an outermost coating layer positioned on the outermost side with respect to the base paper contains at least a pigment, a binder, a lubricant, a dispersant and a cationic resin, wherein the pigment in the outermost coating layer contains kaolin and calcium carbonate, a content of the kaolin and the calcium carbonate is 80 parts by mass or more based on 100 parts by mass of the pigment in the outermost coating layer, and a mass content ratio of the kaolin to the calcium carbonate in the outermost coating layer is 1:9 to 6:4, and the printing paper satisfies the characteristic (I) above.

According to [2] above, while the printing paper has suitability for an offset printing press, the printing paper can have the qualities of color development property, resistance to strike-through and resistance to poor dot diffusion with respect to an inkjet printing press.

[3] The printing paper according to [1] above, having a base paper, and one or more coating layer(s) arranged on at least one surface of the base paper, wherein, in the coating layer(s), an outermost coating layer positioned on the outermost side with respect to the base paper contains at least a pigment, a binder, a lubricant, a dispersant and a cationic resin, wherein the pigment in the outermost coating layer contains kaolin and calcium carbonate, a content of the kaolin and the calcium carbonate is 80 parts by mass or more based on 100 parts by mass of pigment in the outermost coating layer, and a mass content ratio of the kaolin to the calcium carbonate in the outermost coating layer is 1:9 to 6:4, and the printing paper satisfies the characteristic (II) above.

According to [3] above, while the printing paper has suitability for an offset printing press, the printing paper can have the qualities of color density uniformity, dot reproducibility and resistance to cockling with respect to an inkjet printing press.

[4] The printing paper according to [3] above, wherein for the side having the outermost coating layer of the printing paper, a transfer amount of an aqueous solution having a surface tension of 20 mN/m at a contact time of 0.4 second as determined by the Bristow method is further measured, and a value of [the transfer amount of the aqueous solution having a surface tension of 20 mN/m at a contact time of 1 second as determined by the Bristow method]—[the transfer amount of the aqueous solution having a surface tension of 20 mN/m at a contact time of 0.4 second as determined by the Bristow method] is 0.5 ml/m$^2$ or more and 2.5 ml/m$^2$ or less.

According to [4] above, the printing paper can further improve the quality of color density uniformity or resistance to cockling with respect to an inkjet printing press.

[5] The printing paper according to [1] above, having a base paper, and one or more coating layer(s) arranged on at least one surface of the base paper, wherein, in the coating layer(s), an outermost coating layer positioned on the outermost side with respect to the base paper contains at least a pigment, a binder, a lubricant, a dispersant and a cationic resin, wherein the pigment in the outermost coating layer contains kaolin and calcium carbonate, a content of the kaolin and the calcium carbonate is 80 parts by mass or more based on 100 parts by mass of the pigment in the outermost coating layer, and a mass content ratio of the kaolin to the calcium carbonate in the outermost coating layer is 1:9 to 6:4, and the printing paper satisfies the characteristic (III) above.

According to [5] above, while the printing paper has suitability for an offset printing press, the printing paper can have the qualities of resistance to printing stain, character visibility and scratch resistance with respect to an inkjet printing press.

BRIEF EXPLANATION OF THE DRAWINGS

FIG. 1 is a schematic diagram of an apparatus for measuring the specular reflection light quantity of a point image.

MODE FOR. CARRYING OUT THE INVENTION

The present invention will be described below in detail.

The printing paper of the present invention has a base paper, and one or more coating layer(s) arranged on at least one surface of the base paper. In the coating layer(s), an outermost coating layer positioned on the outermost side with respect to the base paper contains at least a pigment, a binder, a lubricant, a dispersant and a cationic resin.

In the present invention, "having a coating layer" means a paper having a distinct coating layer that can be distinguished from a base paper when observing a cross section of the paper with an electron microscope. For example, in the case where a resin component or a polymer component is coated, the amount of the coated components is small and absorbed by the base paper, and as a result, the printing paper does not have a distinct layer that can be distinguished from the base paper when observing a cross section of the printing paper with an electron microscope, it does not correspond to "having a coating layer".

The base paper is a raw paper sheet produced from paper stock obtained by mixing at least one type of pulp selected from chemical pulp such as leaf bleached haft pulp (LBKP) and needle bleached kraft pulp (NBKP), mechanical pulp such as groundwood pulp (GP), pressure groundwood pulp (PGW), refiner mechanical pulp (RMP), thermo mechanical pulp (TMP), chemi-thermo mechanical pulp (CTMP), chemi mechanical pulp (CMP), and chemi groundwood pulp (CGP), and waste paper pulp such as de-inked pulp (DIP), and one or more types of various fillers, such as precipitated calcium carbonate, ground calcium carbonate, talc, clay and kaolin, and one or more types of various additives such as a sizing agent, a fixing agent, a retention aid, a cationization agent such as a cationic resin and a polyvalent cationic ion salt, and a paper strengthening agent, as necessary. Further, the base paper may include woodfree paper obtained by subjecting calendering processing, surface sizing with starch, polyvinyl alcohol or the like, or surface treatment to the raw paper. Furthermore, the base paper may include woodfree paper subjected to surface sizing or surface treatment followed by calendering processing.

In the paper stock, one or two kinds of other additives, such as a pigment dispersant, a thickener, a fluidity improver, a defoamer, an antifoamer, a releasing agent, a foaming agent, a penetrating agent, a colored dye, a colored pigment, an optical brightener, an ultraviolet light absorber, an antioxidant, a preservative, a fungicide, an insolubilizer, an wetting paper strengthening agent and a drying paper strengthening agent may be incorporated as long as desired effects of the invention are not impaired.

The coating layer can be provided on at least one side of the base paper by applying and drying a coating composition of the coating layer. The coating layer includes one layer or two or more layers. In the coating layer, a coating layer positioned on the outermost side with respect to the base paper is referred to as an outermost coating layer. When the coating layer includes one layer, the coating layer means the outermost coating layer. The outermost coating layer contains at least a pigment, a binder, a lubricant, a dispersant and a cationic resin. For the coating layer existing between the base paper and the outermost coating layer, the presence or absence and type of each of a pigment, a binder, a lubricant, a dispersant and a cationic resin are not particularly limited.

The each coating amount of the coating layer(s) is not particularly limited. A preferable coating amount is in the range of 5 $g/m^2$ to 30 $g/m^2$ per one side in dry solid content. When the coating layer is composed of two or more layers, the above value is the total value of them. When the coating layer is composed of two or more layers, it is preferable that the outermost coating layer accounts for 70% by mass of the coating amount per one side in dry solid content.

The coating layer may be provided on one side or both sides of the base paper. When the coating layer is provided on one side of the base paper, a conventional back coat layer may be provided on the surface of the base paper opposite to the side having the coating layer.

A method of providing the coating layer on the base paper is not particularly limited. For example, there can be mentioned a method of applying and drying a coating composition of a coating layer using a coating apparatus and a drying apparatus conventionally known in the papermaking field. Examples of the coating apparatus include a comma coater, a film press coater, an air knife coater, a rod blade coater, a bar coater, a blade coater, a gravure coater, a curtain coater, an E bar coater, a film transfer coater, and the like. Examples of the drying apparatus include various drying apparatuses such as a hot air dryer such as a straight tunnel dryer, an arch dryer, an air loop dryer and a sine curve air float dryer, an infrared heating dryer, a dryer using microwave, and the like.

The coating layer can be subjected to calendering process.

The calendering process is a process of averaging smoothness and thickness by passing paper between rolls. Examples of calendering apparatuses include a machine calender, a soft nip calender, a super calender, a multistage calender, a multi nip calender, and the like.

The printing paper of the present invention does not include the printing paper on which the outermost coating layer has been subjected to cast processing.

The printing paper of the present invention satisfies at least one of the following characteristics (I), (II) and (III). It is more preferable to satisfy two characteristics selected from the characteristics (I) to (III), and it is further preferable to satisfy all of the characteristics (I) to (III).

(I) When an aqueous solution having a surface tension of 20 mN/m is dropped on the side having the outermost coating layer of the printing paper, a contact angle between the droplet and the outermost coating layer is 40° or more and 65° or less.

(II) For the side having the outermost coating layer of the printing paper, a transfer amount of an aqueous solution having a surface tension of 20 mN/m at a contact time of 1 second as determined by the Bristow method is 5.0 $ml/m^2$ or more and 12.0 $ml/m^2$ or less.

(III) On the surface of the outermost coating layer of the printing paper, a maximum peak value of specular reflection light quantity of a point image is 2,000 or more and 30,000 or less.

The characteristic (I) will be described.

The printing paper satisfying the characteristic (I) is such that when an aqueous solution having a surface tension of 20 mN/m is dropped on the side having the outermost coating layer of the printing paper, the contact angle between the droplet and the outermost coating layer is 40° or more and 65° or less. Recent inkjet printing presses tend to use low surface tension inks aiming to be able to print with conventional offset printing paper. Therefore, it is possible to perform evaluation in accordance with an actual inkjet printing press by measuring the contact angle using an aqueous solution having a lower surface tension than the contact angle measurement using ion exchanged water having a high surface tension.

The contact angle can be measured by dropping 1 μl of an aqueous solution having a surface tension of 20 mN/m onto the outermost coating layer of the printing paper, and measuring after 1 second from the contact of the droplet with the surface of the outermost coating layer of the printing paper using a commercially available contact angle measuring apparatus having an image data analyzing apparatus. The image data analysis can be performed by a curve fitting method in which calculation is conducted assuming that the shape of the droplet is a sphere or a part of an ellipsoid. An example of such a contact angle measuring apparatus is an automatic contact angle meter CA-VP 300 manufactured by Kyowa Interface Science Co., Ltd. In the present invention, 1 μl of the droplet may be in the range of 1 μl±20%, and there is no trouble in the measurement so long as it is in this range.

In the case where the contact angle between the droplet and the outermost coating layer is less than 40° when the aqueous solution having a surface tension of 20 mN/m is dropped, it is impossible to acquire color development property, resistance to strike-through or resistance to poor dot diffusion. In the case where the contact angle between the droplet and the outermost coating layer is more than 65° when the aqueous solution having a surface tension of 20 mN/m is dropped, it is impossible to acquire color development property or resistance to poor dot diffusion.

The surface tension of the aqueous solution is the value measured by the Wilhelmy plate method.

The aqueous solution having a surface tension of 20 mN/m to be used for measuring the contact angle may be any aqueous solution having a surface tension of 20 mN/m as determined by the Wilhelmy plate method, and it is obtained by adding an appropriate amount of an alcohol such as glycerin, polyethylene glycol, propylene glycol, ethanol or ethylene glycol, or a fluorine-based surfactant such as perfluoroalkylsulfonic acid to ion exchanged water.

The contact angle of the coating layer is a physical quantity conventionally known in the papermaking field as described, for example, in JP 2014-80715 A1 and WO 2011/001955, and it can be adjusted by methods conventionally known in the papermaking field. The contact angle of the coating layer can be achieved by, for example, combining each condition such as an coating amount, a type of pigment, an average particle size of the pigment, a particle size distribution of the pigment, a shape of the pigment, an oil absorption degree of the pigment, a type of binder, a molecular weight or degree of polymerization, a mixing ratio of the water dispersible binder and water soluble binder, and a content ratio of the pigment to the binder. In particular, the contact angle tends to decrease as, for example, the hydrophilic pigment is increased, the water-soluble binder ratio is increased, the proportion of the binder is reduced, the dispersant and the ionic compound such as a cationic resin is incorporated or the amount thereof to be applied is reduced. The contact angle tends to increase as, for example, the ratio of water dispersible binder is increased, a lubricant is incorporated, or a relatively hydrophobic surfactant having a long chain alkyl group is incorporated. In addition, since the state of the layer surface is changed, the contact angle varies depending on whether or not a calendering processing is performed after applying and drying a coating solution of the outermost coating layer, or calendering processing conditions. The contact angle varies depending on a drying method at the time of providing the outermost coating layer since the state of the formed layer changes somewhat.

The characteristic (II) will be described.

A printing paper satisfying the characteristic (II) is such that, for the side having the outermost coating layer of the printing paper, the transfer amount of the aqueous solution having a surface tension of 20 mN/m at a contact time of 1 second as determined by the Bristow method is 5.0 ml/m$^2$ or more and 12.0 ml/m$^2$ or less.

The transfer amount of the aqueous solution determined by the Bristow method is a water absorption amount (ml/m$^2$) as measured at a contact time of 1 second or 0.4 seconds of a sample using an aqueous solution having a surface tension of 20 mN/m, and using a head having a slit width of 0.5 mm, Recent inkjet printing presses tend to use low surface tension inks aiming to be able to print with conventional offset printing paper. Therefore, it is possible to perform evaluation in accordance with an actual inkjet printing press by measuring the contact angle using an aqueous solution having a lower surface tension than the contact angle measurement using ion exchanged water having a high surface tension.

If the transfer amount of the aqueous solution having a surface tension of 20 mN/m at a contact time of 1 second as determined by the Bristow method is less than 5.0 ml/m$^2$ for the side having the outermost coating layer of the printing paper, it is impossible to acquire color density uniformity. If the transfer amount of the aqueous solution having a surface tension of 20 mN/m at a contact time of 1 second as determined by the Bristow method is more than 12.0 ml/m$^2$, it is impossible to acquire dot reproducibility or resistance to cockling.

In a further preferred embodiment of the present invention, for the side having the outermost coating layer of the printing paper, the transfer amount of the aqueous solution having a surface tension of 20 mN/m at a contact time of 1 second as determined by the Bristow method is 5.0 ml/m$^2$ or more and 12.0 ml/m$^2$ or less, and the transfer amount of the aqueous solution having a surface tension of 20 mN/m at a contact time of 0.4 second as determined by the Bristow method is further measured, and the value of [the transfer amount of the aqueous solution having a surface tension of 20 mN/m at a contact time of 1 second as determined by the Bristow method]—[the transfer amount of the aqueous solution having a surface tension of 20 mN/m at a contact time of 0.4 second as determined by the Bristow method] is 0.5 ml/m$^2$ or more and 2.5 ml/m$^2$ or less. This is because the color density uniformity or resistance to cockling is further improved.

For the side having the outermost coating layer of the printing paper, the transfer amount of the aqueous solution having a surface tension of 20 mN/m at a contact time of 0.4 second as determined by the Bristow method is preferably 4.5 ml/m$^2$ or more and 9.5 ml/m$^2$ or less.

The surface tension of the aqueous solution is the value measured by the Wilhelmy plate method.

The aqueous solution having a surface tension of 20 mN/m to be used for measuring the contact angle may be any aqueous solution having a surface tension of 20 mN/m as determined by the Wilhelmy plate method, and it is obtained by adding an appropriate amount of an alcohol such as glycerin, polyethylene glycol, propylene glycol, ethanol or ethylene glycol, or a fluorine-based surfactant such as perfluoroalkylsulfonic acid to ion exchanged water.

The transfer amount of the aqueous solution is a physical quantity conventionally known in the papermaking field as described in, for example, Japanese Patent No. 5081592, and can be adjusted by a conventionally known method in the papermaking field. The transfer amount of the aqueous solution can be achieved by combining each condition such as coating amount, a type of pigment, an average particle size of the pigment, a particle size distribution of the pigment, a shape of the pigment, an oil absorption degree of the pigment, a type of binder, a molecular weight or degree of polymerization, a mixing ratio of the water dispersible binder and water soluble binder, and a content ratio of the pigment to the binder. In particular, the transfer amount tends to increase as, for example, the hydrophilic pigment is increased, the water-soluble binder ratio is increased, the proportion of the binder is reduced, the dispersant and the ionic compound such as a cationic resin are incorporated or the amount thereof to be applied is reduced. The transfer amount tends to increase as, for example, the ratio of water dispersible binder is increased, a lubricant is incorporated, or a relatively hydrophobic surfactant having a long chain alkyl group is incorporated. In addition, since the state of the layer surface is changed, the transfer amount varies depending on whether or not a calendering processing is performed after applying and drying a coating solution of the outermost coating layer, or calendering processing conditions. The transfer amount varies depending on a drying method at the time of providing the outermost coating layer since the state of the formed layer changes somewhat.

The characteristic (III) will be described.

The printing paper satisfying the characteristic (III) is such that, on the surface of the outermost coating layer of the printing paper, the maximum peak value of specular reflection light quantity of a point image is 2,000 or more and 30,000 or less. The maximum peak value of specular reflection light quantity of a point image is preferably more than 2,000 and 30,000 or less. When the maximum peak value of specular reflection light quantity of a point image is less than 2,000 on the surface of the outermost coating layer of the printing paper, it is impossible to acquire character visibility. When the maximum peak value of specular reflection light quantity of a point image is more than 30,000, it is impossible to acquire scratch resistance.

The specular reflection light quantity and the maximum peak value of the point image can be measured by a specular reflection light quantity measurement apparatus composed of an incident apparatus described in Patent Document 3 using an optical device manufactured by Chuo Seiki Co., Ltd., a sample bed and a light receiving apparatus (see FIG. 1). Printing paper is used as a sample, incident light is specularly reflected on the surface of the outermost coating layer of the printing paper, and the reflected light is measured as measurement light. As shown in FIG. 1, an LED lamp is used as a light source of the incident apparatus (1), a point image (diameter: 100 μm) is incident on a sample (4) of printing paper placed on the sample bed (3) as parallel light by a collimator lens of the same incident apparatus (1), and the parallel light having specularly reflected is focused by a collimator lens of the light receiving apparatus (2) and returned to a point image. This point image is measured as a two-dimensional light quantity distribution by a CMOS camera or the like possessed by the light receiving apparatus (2), to obtain a specular reflection light quantity distribution of the point image. For specular reflection light quantity distribution of a point image, the x axis y axis is the distribution position (determined by a pixel such as a CMOS camera or image analysis software) and the z axis is light intensity. The maximum peak is obtained from the specular reflection light quantity distribution of the obtained point image. Maximum peak means the highest peak of one or more peaks.

In the present invention, the CMOS camera has 1,024 pixels×1,024 pixels. The LED light source was adjusted so that the measurement light quantity was about 40,000 based on the surface of the paper BW art post 256 g/m$^2$ manufactured by Mitsubishi Paper Mills Limited. In the case of measuring the specular reflection light quantity of the point image of the printing paper, the angle=θ (6) from the normal (5) to the sample bed (3) in FIG. 1 was set to 75 degrees.

The maximum peak value of specular reflection light quantity of a point image is related to the gloss feeling and can be adjusted by a method conventionally known in the papermaking field like the glossy feeling. The maximum peak value of specular reflection light quantity of a point image can be achieved by, for example, combining each condition such as coating amount, a type of pigment, an average particle size of the pigment, a particle size distribution of the pigment, a shape of the pigment, and a content ratio of the pigments to a binder. In particular, the maximum peak value of specular reflection light quantity of a point image tends to increase, according to the type and ratio of the pigment, decrease of binder ratio, formulation of the dispersant, and increase of the coating amount. The maximum peak value of specular reflection light quantity of a point image tends to decrease, according to increase in binder ratio, and blending of a lubricant, a cationic resin and a relatively hydrophobic surfactant having long chain alkyl group. In addition, since the state of the layer surface is changed, the maximum peak value of specular reflection light quantity of a point image varies depending on whether or not a calendering processing is performed after applying and drying a coating solution of the outermost coating layer, or calendering processing conditions. The maximum peak value of specular reflection light quantity of a point image varies depending on a drying method at the time of providing the outermost coating layer since the state of the formed layer changes somewhat.

The outermost coating layer of the printing paper contains at least a pigment, a binder, a lubricant, a dispersant and a cationic resin.

Due to the synergistic effect of the specific materials blend and the specific contact angle range in the outermost coating layer, while the printing paper has suitability for an offset printing press, the printing paper can have the color development property, resistance to strike-through and resistance to poor dot diffusion for an inkjet printing press. If the combination of specific materials blend and the specific contact angle range are not satisfied, the printing paper cannot obtain all of the color development property, resistance to strike-through and resistance to poor dot diffusion with respect to an inkjet printing press.

Further, due to the synergistic effect of the specific materials blend and the specific transfer amount range in the outermost coating layer, while the printing paper has suitability for an offset printing press, the printing paper can have the color density uniformity, dot reproducibility and resistance to cockling for an inkjet printing press. If the combination of specific materials blend and the specific transfer amount range are not satisfied, the printing paper cannot obtain at least one of the color density uniformity, dot reproducibility and resistance to cockling with respect to an inkjet printing press.

Further, due to the synergistic effect of the specific materials blend and the specific maximum peak value range of the specular reflection light quantity of the point image in the outermost coating layer, while the printing paper has suitability for an offset printing press, the printing paper can have the resistance to printing stain, character visibility and scratch resistance for an inkjet printing press. If the combination of specific materials blend and the specific maximum peak value range of the specular reflection light quantity of the point image are not satisfied, the printing paper cannot obtain at least one of the resistance to printing stain, character visibility and scratch resistance with respect to an inkjet printing press.

The pigment of the outermost coating layer contains kaolin and calcium carbonate.

The mass content ratio of the kaolin to the calcium carbonate in the outermost coating layer is kaolin:calcium carbonate=1:9 to 6:4. Calcium carbonate is preferably ground calcium carbonate from the viewpoint of printing suitability for an inkjet printing press.

In addition to the kaolin and the calcium carbonate, the outermost coating layer can contain a conventionally known pigment. Examples of the conventionally known pigment can include inorganic pigments such as talc, satin white, lithopone, titanium oxide, zinc oxide, silica, alumina, aluminum hydroxide, activated clay and diatomaceous earth, and organic pigments such as plastic pigments. The outermost coating layer can contain one or a combination of two or more of these pigments in combination with kaolin and calcium carbonate.

The proportion of kaolin and calcium carbonate in the pigment of the outermost coating layer is 80% by mass or more.

The binder of the outermost coating layer is a conventionally known binder. Examples of the conventionally known binder can include starch and various modified starches thereof, cellulose derivatives such as carboxymethyl cellulose and hydroxyethyl cellulose, natural polymer resins such as casein, gelatin, soybean protein, pullulan, gum arabic, karaya gum and albumin or derivatives thereof, polyvinyl pyrrolidone, polyvinyl alcohol and various modified polyvinyl alcohols thereof, polypropylene glycol, polyethylene glycol, maleic anhydride resin, acrylic resin, methacrylic acid ester-butadiene resin, styrene-butadiene resin, ethylene-vinyl acetate resin or functional group-modified resins obtained by incorporating a functional group (such as a carboxy group)-containing monomer into these various resins, binders of thermosetting synthetic resins such as melamine resin and urea resin, polyurethane resin, unsaturated polyester resin, polyvinyl butyral, alkyd resin latex, and the like. The outermost coating layer contains one kind or two or more kinds selected from the group consisting of these binders.

The binder of the outermost coating layer is preferably one or two or more selected from the group consisting of starch and various modified starch thereof, polyvinyl alcohol and various modified polyvinyl alcohols thereof, and styrene-butadiene resin.

The content of the binder in the outermost coating layer is preferably 3 parts by mass or more and 40 parts by mass or less, more preferably 5 parts by mass or more and 25 parts by mass or less, based on 100 parts by mass of the pigment in the outermost coating layer.

The lubricant of the outermost coating layer is a conventionally known lubricant. Examples of the conventionally known lubricant can include a higher fatty acid salt, a wax and an organosilicon compound. Examples of the higher fatty acid salt include a metal salt (e.g., sodium, potassium, zinc and calcium salts thereof) of a higher fatty acid such as laurate, oleate, palmitate, stearate and myristate, and an ammonium salt of a higher fatty acid such as ammonium laurate, ammonium oleate, ammonium palmitate, ammonium stearate, and ammonium myristate. Examples of the wax include vegetable wax, animal wax, montan wax, paraffin wax, synthetic wax (hydrocarbon synthetic wax, polyethylene emulsion wax, higher fatty acid ester, fatty acid amide, ketone-amines, hydrogen hardened oil, etc.), aliphatic hydrocarbons such as polypropylene and polytetrafluoroethylene polymer and derivatives thereof. Examples of the organosilicon compound include polyalkylsiloxanes and derivatives thereof, dimethyl silicone oil, methylphenyl silicone oil, alkyl-modified silicone oil, alkyl-aralkyl modified silicone oil, amino-modified silicone oil, polyether-modified silicone oil, higher fatty acid-modified silicone oil, carboxyl-modified silicone oil, fluorine-modified silicone oil, epoxy-modified silicone oil, and the like. The outermost coating layer contains one or more selected from the group consisting of these lubricants.

The lubricant of the outermost coating layer is preferably a higher fatty acid salt.

The content of the lubricant in the outermost coating layer is preferably 0.01 $g/m^2$ or more and 0.3 $g/m^2$ or less per side.

The dispersant in the outermost coating layer is a material for dispersing an water-insoluble substance such as a pigment in an aqueous solution and is a conventionally known dispersant. Examples of the conventionally known dispersant include a polycarboxylic acid resin such as sodium polycarboxylate, an acrylic resin such as sodium polyacrylate, a styrene-acrylic resin, an isobutylene-maleic acid resin, a sulfonated polystyrene resin, polyvinyl alcohol and modified polyvinyl alcohol, condensed phosphate and the like. The outermost coating layer contains one kind or two or more kinds selected from these dispersants.

The dispersant in the outermost coating layer is preferably one or two or more selected from the group consisting of a polycarboxylic acid resin and an acrylic resin.

The content of the dispersant in the outermost coating layer is preferably 0.001 $g/m^2$ or more and 0.1 $g/m^2$ or less per side. Among the dispersant, there is a material that overlaps the binder. However, the content of the material used as the dispersant in the outermost coating layer is clearly smaller than that of the binder, and the dispersant is smaller in molecular weight than the binder, so that the dispersant and the binder are distinguishable. Although the pigment can be dispersed by the presence of the binder, by containing the dispersant in the outermost coating layer, it is possible to improve the color development property and resistance to poor dot diffusion, to improve the dot reproducibility, or to improve the resistance to printing stain or character visibility.

The cationic resin of the outermost coating layer is a conventionally known cationic resin. A preferred cationic resin is a polymer or an oligomer containing a primary to tertiary amine or a quaternary ammonium salt which is easily coordinated with a proton and dissociates when dissolved in water to give a cationic property. Further, a preferred cationic resin is a low cationic resin having a cationization degree of more than 0 meq/g and 3 meq/g or less or a highly cationic resin having a cationization degree of more than 3 meq/g. Here, the cationization degree is a value measured by a colloid titration method.

Examples of the conventionally known cationic resin include polyethyleneimine, polyamine and modified polyamine, polyvinylpyridine, polyamidoamine, polyvinylamine, modified polyamide, polyacrylamide, polyallylamine, polydialkylaminoethyl methacrylate, polydialkylaminoethyl acrylate, polydialkylaminoethyl methacrylamide, polydialkylaminoethylacrylamide, polyvinylbenzyltrimethylammonium chloride, polydiallyldimethylammonium chloride, a copolymer of allyldimethylammonium chloride and acrylamide and the like, a polycondensate of an aliphatic polyamine and an epihalohydrin compound such as a dimethylamine-epichlorohydrin polycondensate or a polycondensate of an aliphatic polyamine and an epihalohydrin compound such as diethylenetriamine-epichlorohydrin polycondensate, polyamine polyamide epichlorohydrin, dicyandiamide-formalin polycondensate, dicyandiamide diethylenetriamine polycondensate, polyepoxyamine, polyamide-epoxy resin, melamine resin, and urea resin. The outermost coating layer contains one or two or more selected from the group consisting of these cationic resins. The average molecular weight of the cationic resin is not particularly limited. The average molecular weight of the cationic resin is preferably 500 or more and 100,000 or less, and more preferably 1,000 or more and 60,000 or less.

The cationic resin of the outermost coating layer is preferably a modified polyamine or a modified polyamide.

The content of the cationic resin in the outermost coating layer is preferably 0.01 g/m$^2$ or more and 0.5 g/m$^2$ or less per side.

The outermost coating layer can further contain various additives conventionally known in the field of coated paper, if necessary. Examples of the additives can include a thickener, a fluidity improver, a defoamer, a foaming agent, a penetrating agent, a colored pigment, a colored dye, an optical brightener, an ultraviolet light absorber, an antioxidant, a preservative, a fungicide and the like.

EXAMPLES

The present invention is described below more specifically using examples. It should be noted that the present invention is not limited to these examples. Here, "part by mass" and "% by mass" each represent "parts by mass" and "% by mass" of the dry solid content or the substantial component amount. The coating amount of the coating layer represents the dry solid content.

<Base Paper>

To pulp slurry composed of 100 parts by mass of LBKP having a freeness of 400 mL csf, 8 parts by mass of calcium carbonate as a filler, 1.0 part by mass of an amphoteric starch, 0.8 part by mass of aluminum sulfate, and an internal sizing agent were added to make a paper stock, which was formed into raw paper using the Fourdrinier papermaking machine. Starch was adhered to both sides of the obtained raw paper with a size press apparatus and the paper was subjected to machine calendering processing to prepare a base paper.

<Coating Composition of Outermost Coating Layer>

The coating composition of the outermost coating layer was prepared according to the following contents.

Kaolin: the number of parts is shown in each Table

Calcium carbonate: the number of parts is shown in each Table

Silica: the number of parts is shown in each Table

Starch: the number of parts is shown in each Table

Styrene-butadiene type resin: the number of parts is shown in each Table

Lubricant: the type and the number of parts are shown in each Table

Dispersant: the type and the number of parts are shown in each Table

Cationic resin: the type and the number of parts are shown in each Table

The above contents were blended, mixed and dispersed with water, and the concentration was adjusted to 48% by mass.

<Printing Paper of Examples (I)-1 to (I)-14 and Comparative Examples (1)-1 to (I)-15>

Printing paper was prepared by the following procedure.

The coating composition of the outermost coating layer was applied on the both surfaces of the base paper using a blade coater, and then dried. After the drying, calendering processing was performed. The coating amount of the coating composition was 14 g/m$^2$ per one surface.

When an aqueous solution having a surface tension of 20 mN m was dropped, the contact angle between the droplet and the outermost coating layer at 1 second after the contact was adjusted primarily by blending the pigment, the lubricant, the dispersant, and the cationic resin, and supplementarily by calendaring processing. An aqueous solution having a surface tension of 20 mN/m was prepared by adding propylene glycol and a fluorine-based surfactant to ion-exchanged water so that the surface tension by the Wilhelmy plate method was 20 mN/m.

TABLE 1

| | Pigment | | | Binder | | | | | | | | |
|---|---|---|---|---|---|---|---|---|---|---|---|---|
| | Kaolin Part by mass | Calcium carbonate Part by mass | Silica Part by mass | Starch Part by mass | Styrene-butadiene type resin Part by mass | Lubricant Type Part by mass | Dispersant Type Part by mass | Cationic resin Type Part by mass | Contact angle (after 1 second) (o) | Evaluation of color development property | Evaluation of resistance to strike-through | Evaluation of resistance to poor dot diffusion |
| Example (I)-1 | 40 | 60 | | 4 | 10 | Calcium stearate 0.6 | Acrylic type resin 0.3 | Modified polyamide 0.5 | 58 | 5 | 5 | 5 |

TABLE 1-continued

| | Pigment | | | Binder | | | | | | | | |
|---|---|---|---|---|---|---|---|---|---|---|---|---|
| | Kaolin Part by mass | Calcium carbonate Part by mass | Silica Part by mass | Starch Part by mass | Styrene-butadiene type resin Part by mass | Lubricant Type Part by mass | Dispersant Type Part by mass | Cationic resin Type Part by mass | Contact angle (after 1 second) (o) | Evaluation of color development property | Evaluation of resistance to strike-through | Evaluation of resistance to poor dot diffusion |
| Example (I)-2 | 60 | 40 | | 4 | 10 | Calcium stearate 0.6 | Acrylic type resin 0.3 | Modified polyamide 0.5 | 65 | 5 | 5 | 4 |
| Example (I)-3 | 10 | 90 | | 4 | 10 | Calcium stearate 0.6 | Acrylic type resin 0.3 | Modified polyamide 0.5 | 42 | 4 | 4 | 4 |
| Example (I)-4 | 30 | 70 | | 4 | 10 | Calcium stearate 0.6 | Acrylic type resin 0.3 | Modified polyamIde 0.5 | 50 | 5 | 5 | 5 |
| Example (I)-5 | 32 | 48 | 20 | 4 | 10 | Calcium stearate 0.6 | Acrylic type resin 0.3 | Modified polyamide 0.5 | 40 | 4 | 3 | 4 |
| Example (I)-6 | 40 | 60 | | 4 | 10 | Ammonium oleate 0.6 | Acrylic type resin 0.3 | Modified polyamide 0.5 | 59 | 5 | 5 | 4 |
| Example (I)-7 | 40 | 60 | | 4 | 10 | Calcium stearate 0.6 | Poly-carboxylic acid type resin 0.3 | Modified polyamide 0.5 | 56 | 5 | 5 | 5 |
| Example (I)-8 | 40 | 60 | | 4 | 10 | Calcium stearate 0.6 | Acrylic type resin 0.3 | Modified polyamine 0.5 | 56 | 5 | 5 | 5 |
| Example (I)-9 | 40 | 60 | | 4 | 10 | Calcium stearate 0.1 | Acrylic type resin 0.3 | Modified polyamide 0.5 | 56 | 5 | 4 | 4 |
| Example (I)-10 | 40 | 60 | | 4 | 10 | Calcium stearate 2.5 | Acrylic type resin 0.3 | Modified polyamide 0.5 | 64 | 4 | 5 | 3 |
| Example (I)-11 | 40 | 60 | | 4 | 10 | Calcium stearate 0.6 | Acrylic type resin 0.01 | Modified polyamide 0.5 | 63 | 4 | 5 | 3 |
| Example (I)-12 | 40 | 60 | | 4 | 10 | Calcium stearate 0.6 | Acrylic type resin 0.8 | Modified polyamide 0.5 | 55 | 4 | 4 | 4 |
| Example (I)-13 | 40 | 60 | | 4 | 10 | Calcium stearate 0.6 | Acrylic type resin 0.3 | Modified polyamide 0.1 | 63 | 4 | 4 | 3 |
| Example (I)-14 | 40 | 60 | | 4 | 10 | Calcium stearate 0.6 | Acrylic type resin 0.3 | Modified polyamide 4.2 | 50 | 4 | 5 | 4 |
| Comparative Example (I)-1 | 5 | 95 | | 4 | 10 | Calcium stearate 0.6 | Acrylic type resin 0.3 | Modified polyamide 0.5 | 38 | 2 | 1 | 2 |
| Comparative Example (I)-2 | 65 | 35 | | 4 | 10 | Calcium stearate 0.6 | Acrylic type resin 0.3 | Modified polyamide 0.5 | 67 | 3 | 5 | 2 |
| Comparative Example (I)-3 | 10 | 90 | | 4 | 10 | Calcium stearate 0 | Acrylic type resin 0.3 | Modified polyamide 0.5 | 39 | 3 | 2 | 2 |
| Comparative Example (I)-4 | 40 | 60 | | 0 | 0 | Calcium stearate 0.6 | Acrylic type resin 0.3 | Modified polyamide 10 | 33 | 1 | 1 | 1 |
| Comparative Example (I)-5 | 60 | 40 | | 4 | 10 | Calcium stearate 0.6 | Acrylic type resin 0 | Modified polyamide 0.5 | 68 | 2 | 5 | 2 |
| Comparative Example (I)-6 | 60 | 40 | | 4 | 10 | Calcium stearate 0.6 | Acrylic type resin 0.3 | Modified polyamide 0 | 68 | 1 | 3 | 1 |
| Comparative Example (I)-7 | 35 | 40 | 25 | 4 | 10 | Calcium stearate 0.6 | Acrylic type resin 0.3 | Modified polyamide 0.5 | 30 | 2 | 2 | 2 |
| Comparative Example (I)-8 | 5 | 70 | 25 | 4 | 10 | Calcium stearate 0.6 | Acrylic type resin 0.3 | Modified polyamide 0.5 | 27 | 1 | 1 | 2 |
| Comparative Example (I)-9 | 60 | 40 | | 4 | 10 | Calcium stearate 1.2 | Acrylic type resin 0.3 | Modified polyamide 0.5 | 67 | 2 | 5 | 2 |

TABLE 1-continued

| | Pigment | | | Binder | | | | | | | | |
|---|---|---|---|---|---|---|---|---|---|---|---|---|
| | Kaolin Part by mass | Calcium carbonate Part by mass | Silica Part by mass | Starch Part by mass | Styrene-butadiene type resin Part by mass | Lubricant Type Part by mass | Dispersant Type Part by mass | Cationic resin Type Part by mass | Contact angle (after 1 second) (o) | Evaluation of color development property | Evaluation of resistance to strike-through | Evaluation of resistance to poor dot diffusion |
| Comparative Example (I)-10 | 10 | 90 | | 4 | 10 | Calcium stearate 0.6 | Acrylic type resin 0.8 | Modified polyamide 0.5 | 38 | 3 | 2 | 3 |
| Comparative Example (I)-11 | 30 | 70 | | 4 | 10 | Calcium stearate 0.6 | Acrylic type resin 0 | Modified polyamide 0.5 | 55 | 2 | 5 | 2 |
| Comparative Example (I)-12 | 40 | 60 | | 4 | 10 | Calcium stearate 0 | Acrylic type resin 0.3 | Modified polyamide 0.5 | 53 | 4 | 2 | 2 |
| Comparative Example (I)-13 | 30 | 70 | | 4 | 10 | Calcium stearate 0.6 | Acrylic type resin 0.3 | Modified polyamlde 0 | 59 | 2 | 3 | 2 |
| Comparative Example (I)-14 | 5 | 95 | | 4 | 10 | Calcium stearate 2.5 | Acrylic type resin 0.3 | Modified polyamide 0.5 | 44 | 1 | 2 | 1 |
| Comparative Example (I)-15 | 65 | 35 | | 4 | 10 | Calcium stearate 0.6 | Acrylic type resin 0.3 | Modified polyamide 4.2 | 58 | 3 | 5 | 2 |

<Evaluation of Color Development Property>

Using an inkjet printing press MR 20 MX-7000 manufactured by Miyakoshi Printing Machinery Co., a 6000 m evaluation image was printed with an aqueous pigment ink under the condition of a printing speed of 150 m/min. The image to be evaluated was 3 cm×3 cm square solid patterns recorded in a single continuous row with seven colors, namely, black, cyan, magenta, yellow, and superimposed colors (red, green, blue) created by a combination of two colors out of the above three color inks except black. The printed portion of the solid color image of each color was visually observed, and the color development property was evaluated according to the following criteria. In the present invention, if the evaluation is 3 to 5, it is assumed that the printing paper has a color development property.

5: Both color density and color vividness are good.

4: Color density or color vividness is inferior to "5", but it is generally good.

3: Color density and color vividness are practically non-problematic.

2: Color density or color vividness is inferior to "3", which is problematic in practical use.

1: Both color density and color vividness are inferior, which is problematic in practical use.

<Evaluation of Resistance to Strike-Through>

Using an inkjet printing press MJP 20 MX-7000 manufactured by Miyakoshi Printing Machinery Co., a 6000 m evaluation image was printed with an aqueous pigment ink under the condition of a printing speed of 150 m/min. The image to be evaluated was 10 cm×10 cm square solid patterns of black arranged horizontally and vertically. The degree of whiteness was measured from the opposite side of the black solid image portion by the whiteness measurement method prescribed in JIS P 8148:2001, and "whiteness degree (optical %) of white portion with no printing"-"whiteness degree (optical %) of black solid image portion" was calculated to evaluate resistance to strike-through of ink for printing paper. Measurement of whiteness was carried out using a PF-10 made by NIPPON DENSHOKU INDUSTRIES CO. LTD., with one sample placed on a standard plate and under UV cutting conditions. In the present invention, if the evaluation is 3 to 5, it is assumed that the printing paper has resistance to strike-through.

5: Less than 10 optical %.

4: 10 optical % or more and less than 13 optical %.

3: 13 optical % or more and less than 16 optical %.

2: 16 optical % or more and less than 19 optical %.

1: 19 optical % or more.

<Evaluation of Resistance to Poor Dot Diffusion>

Using an inkjet printing press MJP 20 MX-7000 manufactured by Miyakoshi Printing Machinery Co., a 6000 m evaluation image was printed with an aqueous pigment ink under the condition of a printing speed of 150 m/min. The image to be evaluated was 3 cm×3 cm square solid patterns recorded in a single continuous row with seven colors, namely, black, cyan, magenta, yellow, and superimposed colors (red, green, blue) created by a combination of two colors out of the above three color inks except black. The visibility of white streaks caused by poor dot diffusion was visually observed at the printed portion of solid image with each color to evaluate resistance to poor dot diffusion according to the following criteria. In the present invention, if the evaluation is 3 to 5, it is assumed that the printing paper has resistance to poor dot diffusion.

5: No white streak is confirmed.

4: No white streak is confirmed, but a streak due to shading difference is confirmed slightly.

3: No white streak is confirmed, but a pale streak is confirmed.

2: A thin white streak is confirmed.

1: A white streak is clearly confirmed.

The evaluation results are shown in Table 1.

From Table 1, it can be seen that Examples (1)-1 to (I)-14 corresponding to the present invention have color development property, resistance to strike-through and resistance to poor dot diffusion. On the other hand, it can be seen that Comparative Examples (1)-1 to (I)-15 which do not satisfy the constitution of the present invention cannot have these effects.

<Printing Papers of Examples (II)-1 to (II)-16 and Comparative Examples (II)-1 to (II)-18>

Printing paper was prepared by the following procedure.

The coating composition of the outermost coating layer was applied on the both surfaces of the base paper using a blade coater, and then dried. After the drying, calendering processing was performed. The coating amount of the coating composition was 14 g/m$^2$ per one surface.

The transfer amount of the aqueous solution having a surface tension of 20 mN m determined by the Bristow method was adjusted primarily by blending the pigment, the lubricant, the dispersant, and the cationic resin, and supplementarily by calendering processing and time control of drying temperature. The aqueous solution having a surface tension of 20 mN/m was prepared by adding propylene glycol and a fluorine based surfactant to ion-exchanged water so that the surface tension by the Wilhelmy plate method was 20 mN/m.

TABLE 2

| | Pigment | | | Binder | | | | |
|---|---|---|---|---|---|---|---|---|
| | Kaolin Part by mass | Calcium carbonate Part by mass | Silica Part by mass | Starch Part by mass | Styrene-butadiene type resin Part by mass | Lubricant Type Part by mass | Dispersant Type Part by mass | Cationic resin Type Part by mass |
| Example (II)-1 | 40 | 60 | | 4 | 10 | Calcium stearate 0.6 | Acrylic type resin 0.3 | Modified polyamide 0.5 |
| Example (II)-2 | 60 | 40 | | 4 | 10 | Calcium stearate 0.6 | Acrylic type resin 0.3 | Modified polyamide 0.5 |
| Example (II)-3 | 10 | 90 | | 4 | 10 | Calcium stearate 0.6 | Acrylic type resin 0.3 | Modified polyamide 0.5 |
| Example (II)-4 | 30 | 70 | | 4 | 10 | Calcium stearate 0.6 | Acrylic type resin 0.3 | Modified polyamide 0.5 |
| Example (II)-5 | 32 | 48 | 20 | 4 | 10 | Calcium stearate 0.6 | Acrylic type resin 0.3 | Modified polyamide 0.5 |
| Example (II)-6 | 40 | 60 | | 4 | 10 | Ammonium stearate 0.6 | Acrylic type resin 0.3 | Modified polyamide 0.5 |
| Example (II)-7 | 40 | 60 | | 4 | 10 | Calcium stearate 0.5 | Polycarboxylic acid type resin 0.3 | Modified polyamide 0.5 |
| Example (II)-8 | 40 | 60 | | 4 | 10 | Calcium stearate 0.6 | Acrylic type resin 0.3 | Modified polyamide 0.5 |
| Example (II)-9 | 40 | 60 | | 4 | 10 | Calcium stearate 0.1 | Acrylic type resin 0.3 | Modified polyamide 0.5 |
| Example (II)-10 | 40 | 60 | | 4 | 10 | Calcium stearate 2.5 | Acrylic type resin 0.3 | Modified polyamide 0.5 |
| Example (II)-11 | 40 | 60 | | 4 | 10 | Calcium stearate 0.6 | Acrylic type resin 0.01 | Modified polyamide 0.5 |
| Example (II)-12 | 40 | 60 | | 4 | 10 | Calcium stearate 0.6 | Acrylic type resin 0.8 | Modified polyamide 0.5 |
| Example (II)-13 | 40 | 60 | | 4 | 10 | Calcium stearate 0.6 | Acrylic type resin 0.3 | Modified polyamide 0.1 |
| Example (II)-14 | 40 | 60 | | 4 | 10 | Calcium stearate 0.6 | Acrylic type resin 0.3 | Modified polyamide 4.2 |
| Example (II)-15 | 60 | 40 | | 4 | 10 | Calcium stearate 0.6 | Acrylic type resin 0.3 | Modified polyamide 0.2 |
| Example (II)-16 | 24 | 56 | 20 | 4 | 10 | Calcium stearate 0.6 | Acrylic type resin 0.3 | Modified polyamide 0.3 |
| Comparative Example (II)-1 | 5 | 95 | | 4 | 10 | Calcium stearate 0.0 | Acrylic type resin 0.3 | Modified polyamide 4.2 |
| Comparative Example (II)-2 | 65 | 35 | | 4 | 10 | Calcium stearate 0.6 | Acrylic type resin 0.3 | Modified polyamide 0.5 |
| Comparative Example (II)-3 | 32 | 48 | 20 | 4 | 10 | Calcium stearate 0 | Acrylic type resin 0.3 | Modified polyamide 0.5 |

TABLE 2-continued

| | | | | | | | | |
|---|---|---|---|---|---|---|---|---|
| Comparative Example (II)-4 | 40 | 60 | | 0 | 0 | Calcium stearate 0.6 | Acrylic type resin 0.3 | Modified polyamide 10 |
| Comparative Example (II)-5 | 60 | 40 | | 4 | 10 | Calcium stearate 0.6 | Acrylic type resin 0 | Modified polyamide 0.5 |
| Comparative Example (II)-6 | 60 | 40 | | 4 | 10 | Calcium stearate 0.6 | Acrylic type resin 0.3 | Modified polyamide 0 |
| Comparative Example (II)-7 | 35 | 40 | 25 | 4 | 10 | Calcium stearate 0.6 | Acrylic type resin 0.3 | Modified polyamide 0.5 |
| Comparative Example (II)-8 | 35 | 40 | 25 | 4 | 10 | Calcium stearate 0.6 | Acrylic type resin 0.3 | Modiflad polyamide 0.3 |
| Comparative Example (II)-9 | 5 | 70 | 25 | 4 | 10 | Calcium stearate 0.6 | Acrylic type resin 0.3 | Modified polyamide 0.5 |
| Comparative Example (II)-10 | 60 | 40 | | 4 | 10 | Calcium stearate 1.2 | Acrylic type resin 0.3 | Modified polyamide 0.5 |
| Comparative Example (II)-11 | 10 | 90 | | 4 | 10 | Calcium stearate 0.6 | Acrylic type resin 0.8 | Modified polyamide 0.5 |
| Comparative Example (II)-12 | 30 | 70 | | 4 | 10 | Calcium stearate 0.6 | Acrylic type resin 0 | Modified polyamide 0.5 |
| Comparative Example (II)-13 | 40 | 60 | | 4 | 10 | Calcium stearate 0 | Acrylic type resin 0.3 | Modified polyamide 0.5 |
| Comparative Example (II)-14 | 30 | 70 | | 4 | 10 | Calcium stearate 0.6 | Acrylic type resin 0.3 | Modified polyamide 0 |
| Comparative Example (II)-15 | 5 | 95 | | 4 | 10 | Calcium stearate 2.5 | Acrylic type resin 0.3 | Modified polyamide 0.5 |
| Comparative Example (II)-16 | 65 | 35 | | 4 | 10 | Calcium stearate 0.6 | Acrylic type rests 0.3 | Modified polyamide 1.0 |
| Comparative Example (II)-17 | 60 | 40 | | 4 | 10 | Calcium stearate 1.2 | Acrylic type resin 0.3 | Modified polyamide 0.05 |
| Comparative Example (II)-18 | 10 | 90 | | 4 | 10 | Calcium stearate 0.1 | Acrylic type resin 0.01 | Modified polyamide 4.2 |

| | Bristow method | | | | |
|---|---|---|---|---|---|
| | Transfer amount of the aqueous solution having a surface tension of 20 mN/m at the contact time of 1 second ml/m$^2$ | Difference in transfer amount of the aqueous solution having a surface tension of 20 mN/m at the contact times of 1 second and 0.4 second ml/m$^2$ | Evaluation of color density uniformity | Evaluation of dot reproducibility | Evaluation of resistance to cockling |
| Example (II)-1 | 7.5 | 1.5 | 5 | 5 | 5 |
| Example (II)-2 | 5.2 | 0.6 | 4 | 5 | 5 |
| Example (II)-3 | 9.1 | 1.6 | 4 | 4 | 4 |
| Example (II)-4 | 8.0 | 1.5 | 5 | 5 | 5 |
| Example (II)-5 | 11.8 | 2.4 | 4 | 4 | 3 |
| Example (II)-6 | 7.4 | 1.4 | 4 | 5 | 5 |
| Example (II)-7 | 7.6 | 1.6 | 4 | 4 | 5 |
| Example (II)-8 | 7.7 | 1.5 | 5 | 5 | 5 |
| Example (II)-9 | 7.9 | 1.4 | 5 | 4 | 4 |
| Example (II)-10 | 5.2 | 0.7 | 4 | 5 | 5 |
| Example (II)-11 | 6.8 | 0.9 | 4 | 4 | 4 |
| Example (II)-12 | 8.6 | 1.1 | 5 | 4 | 4 |
| Example (II)-13 | 5.5 | 0.9 | 4 | 4 | 4 |
| Example (II)-14 | 10.5 | 2.3 | 5 | 5 | 4 |
| Example (II)-15 | 5.0 | 0.4 | 3 | 5 | 4 |
| Example (II)-16 | 12.0 | 2.7 | 3 | 4 | 3 |

TABLE 2-continued

| | | | | | |
|---|---|---|---|---|---|
| Comparative Example (II)-1 | 12.2 | 2.3 | 2 | 2 | 2 |
| Comparative Example (II)-2 | 4.9 | 0.7 | 2 | 5 | 3 |
| Comparative Example (II)-3 | 12.1 | 2.4 | 3 | 2 | 2 |
| Comparative Example (II)-4 | 17.0 | 0.3 | 2 | 1 | 1 |
| Comparative Example (II)-5 | 4.5 | 0.6 | 2 | 2 | 3 |
| Comparative Example (II)-6 | 4.7 | 0.4 | 2 | 3 | 2 |
| Comparative Example (II)-7 | 12.3 | 2.6 | 2 | 2 | 2 |
| Comparative Example (II)-8 | 11.7 | 2.3 | 3 | 3 | 2 |
| Comparative Example (II)-9 | 14.5 | 2.8 | 2 | 1 | 1 |
| Comparative Example (II)-10 | 4.8 | 0.5 | 2 | 5 | 5 |
| Comparative Example (II)-11 | 12.2 | 1.5 | 4 | 2 | 3 |
| Comparative Example (II)-12 | 6.0 | 1.0 | 3 | 2 | 4 |
| Comparative Example (II)-13 | 8.1 | 1.5 | 4 | 3 | 2 |
| Comparative Example (II)-14 | 6.5 | 0.5 | 2 | 3 | 3 |
| Comparative Example (II)-15 | 5.9 | 0.6 | 3 | 2 | 2 |
| Comparative Example (II)-16 | 0.0 | 0.5 | 2 | 5 | 4 |
| Comparative Example (II)-17 | 4.8 | 0.4 | 2 | 3 | 3 |
| Comparative Example (II)-18 | 12.1 | 2.7 | 3 | 2 | 2 |

<Evaluation of Color Density Uniformity>

Using an inkjet printing press MJP 20 MX-7000 manufactured by Miyakoshi Printing Machinery Co., a 6000 m evaluation image was printed with an aqueous pigment ink under the condition of a printing speed of 150 m/min. The image to be evaluated was 3 cm×3 cm square solid patterns recorded in a single continuous row with seven colors, namely, black, cyan, magenta, yellow, and superimposed colors (red, green, blue) created by a combination of two colors out of the above three color inks except black. For the color density uniformity, printed portions of solid color image of each color were visually observed and evaluated according to the following criteria. In the present invention, if the evaluation is 3 to 5, it is assumed that the printing paper has color density uniformity.

5: Color density is uniform.

4: Density is slightly non-uniform depending on color.

3: Color density is slightly non-uniform.

2: Color density is partially non-uniform.

1: Color density is non-uniform throughout the printed portion.

<Evaluation of Dot Reproducibility>

Using an inkjet printing press MJP 20 MX-7000 manufactured by Miyakoshi Printing Machinery Co., a 6000 m evaluation image using standard image data (image name: N5A) issued by the Japan Standards Association was printed with an aqueous pigment ink under the condition of a printing speed of 150 m/min. The printed image was visually observed with a microscope as to the extent to which the landed dot shape is collapsed from a perfect circle and sharpness of dot outline, and the dot reproducibility was evaluated according to the following criteria. In the present invention, if the evaluation is 3 to 5, it is assumed that the printing paper has dot reproducibility.

5: It is a perfect circle and sharp.

4: It is roughly a perfect circle and sharp.

3: It is slightly collapsed from a perfect circle, and slightly lacks in sharpness. However, there is no practical problem.

2: It is collapsed somewhat from a perfect circle, and lacks somewhat in sharpness.

1: It is collapsed from a perfect circle, and lacks in sharpness.

<Evaluation of Resistance to Cockling>

Using an inkjet printing press MJP 20 MX-7000 manufactured by Miyakoshi Printing Machinery Co., a 6000 m evaluation image was printed with an aqueous pigment ink under the condition of a printing speed of 150 m/min. The image to be evaluated was 15 cm×30 cm square solid patterns recorded in a single continuous row with seven colors, namely, black, cyan, magenta, yellow, and superimposed colors (red, green, blue) created by a combination of two colors out of the above three color inks except black. The printed portion of the solid color image of each color was visually observed, and the resistance to cockling was evaluated according to the following criteria. In the present invention, if the evaluation is 3 to 5, it is assumed that the printing paper has resistance to cockling.

5: Printed portion does not become wavy shape.

4: Immediately after printing, the printed portion becomes wavy but smoothes immediately.

3: Although the printed portion becomes wavy, the wavy degree is small, which does not cause problems in practical use.

2: The printed portion is wavy, and the wavy degree is large, which may cause problems in practical use.

1: The printed portion is wavy, the wavy degree is markedly large, and printing failure occurs.

The evaluation results are shown in Table 2.

From Table 2, it is understood that Examples (II)-1 to (II)-16 corresponding to the present invention have color density uniformity, dot reproducibility and resistance to cockling. On the other hand, it can be understood that Comparative Examples (II)-1 to (II)-18 which do not satisfy the constitution of the present invention cannot have these effects.

From the comparison between Examples (II)-1 to (II)-5 and Examples (II)-9 to (II)-14 and Examples (11)-15 to (II)-16, for the side having the outermost coating layer of the printing paper, it is understood that the value of [a transfer amount of an aqueous solution having a surface tension of 20 mN/m at a contact time of 1 second determined by Bristow's method]—[a transfer amount of an aqueous solution having a surface tension of 20 mn/m at a contact time of 0.4 second determined by Bristow's method] is preferably 0.5 ml/m$^2$ or more and 2.5 ml/m$^2$ or less.

<Printing Paper of Examples (III)-1 to (III)-14 and Comparative Examples (III)-1 to (III)-15>

Printing paper was prepared by the following procedure.

The coating composition of the outermost coating layer was applied on the both surfaces of the base paper using a blade coater, and then dried. The coating amount of the coating composition was 14 g/m$^2$ per one surface.

The maximum peak value of specular reflection light quantity of a point image was adjusted primarily by blending the pigment, the lubricant, the dispersant, and the cationic resin, and supplementarily by calendering processing and temperature control for each zone of drying equipment.

TABLE 3

| | Pigment | | | Binder | | | | | | | | |
|---|---|---|---|---|---|---|---|---|---|---|---|---|
| | Kaolin Part by mass | Calcium carbonate Part by mass | Silica Part by mass | Starch Part by mass | Styrene-butadiene type resin Part by mass | Lubricant Type Part by mass | Dispersant Type Part by mass | Cationic resin Type Part by mass | Maximum peak value of specular reflection light quantity of a point Image | Evaluation of resistance to printing stain | Evaluation of character visibility | Evaluation of scratch resistance |
| Example (III)-1 | 40 | 60 | | 4 | 10 | Calcium stearate 0.6 | Acrylic type resin 0.3 | Modified polyamide 0.5 | 19000 | 5 | 5 | 5 |
| Example (III)-2 | 60 | 40 | | 4 | 10 | Calcium stearate 0.6 | Acrylic type resin 0.3 | Modified polyamide 0.5 | 29000 | 5 | 5 | 4 |
| Example (III)-3 | 10 | 90 | | 4 | 10 | Calcium stearate 0.6 | Acrylic type resin 0.3 | Modified polyamide 0.5 | 4000 | 5 | 4 | 5 |
| Example (III)-4 | 30 | 70 | | 4 | 10 | Calcium stearate 0.6 | Acrylic type resin 0.3 | Modified polyamide 0.5 | 12000 | 5 | 5 | 5 |
| Example (III)-5 | 32 | 48 | 20 | 4 | 10 | Calcium stearate 0.6 | Acrylic type resin 0.3 | Modified polyamide 0.5 | 2100 | 5 | 5 | 5 |
| Example (III)-6 | 40 | 60 | | 4 | 10 | Ammonium oleate 0.6 | Acrylic type resin 0.3 | Modified polyamide 0.5 | 16000 | 4 | 5 | 5 |
| Example (III)-7 | 40 | 60 | | 4 | 10 | Calcium stearate 0.6 | Polycarboxylic acid type resin 0.3 | Modified polyamide 0.5 | 16000 | 4 | 5 | 5 |
| Example (III)-8 | 40 | 60 | | 4 | 10 | Calcium stearate 0.6 | Acrylic type resin 0.3 | Modified polyamine 0.5 | 17000 | 5 | 5 | 5 |
| Example (III)-9 | 40 | 60 | | 4 | 10 | Calcium stearate 0.1 | Acrylic type resin 0.3 | Modified polyamide 0.5 | 23000 | 4 | 4 | 4 |
| Example (III)-10 | 40 | 60 | | 4 | 10 | Calcium stearate 2.5 | Acrylic type resin 0.3 | Modified polyamide 0.5 | 13000 | 4 | 4 | 3 |
| Example (III)-11 | 40 | 60 | | 4 | 10 | Calcium stearate 0.6 | Acrylic type resin 0.01 | Modified polyamide 0.5 | 7000 | 4 | 4 | 5 |
| Example (III)-12 | 40 | 60 | | 4 | 10 | Calcium stearate 0.6 | Acrylic type resin 0.8 | Modified polyamide 0.5 | 11000 | 4 | 4 | 5 |
| Example (III)-13 | 40 | 60 | | 4 | 10 | Calcium stearate 0.6 | Acrylic type resin 0.3 | Modified polyamide 0.1 | 24000 | 4 | 4 | 4 |
| Example (III)-14 | 40 | 60 | | 4 | 10 | Calcium stearate 0.6 | Acrylic type resin 0.3 | Modified polyamide 4.2 | 5000 | 4 | 4 | 4 |
| Comparative Example (III)-1 | 5 | 95 | | 4 | 10 | Calcium stearate 0.6 | Acrylic type resin 0.3 | Modified polyamide 0.5 | 1900 | 2 | 2 | 5 |

TABLE 3-continued

| | Pigment | | | Binder | | | | | Maximum peak value of specular reflection light quantity of a point Image | Evaluation of resistance to printing stain | Evaluation of character visibility | Evaluation of scratch resistance |
|---|---|---|---|---|---|---|---|---|---|---|---|---|
| | Kaolin Part by mass | Calcium carbonate Part by mass | Silica Part by mass | Starch Part by mass | Styrene-butadiene type resin Part by mass | Lubricant Type Part by mass | Dispersant Type Part by mass | Cationic resin Type Part by mass | | | | |
| Comparative Example (III)-2 | 70 | 30 | | 4 | 10 | Calcium stearate 0.6 | Acrylic type resin 0.3 | Modified polyamide 0.5 | 31000 | 2 | 4 | 2 |
| Comparative Example (III)-3 | 60 | 40 | | 4 | 10 | Calcium stearate 0 | Acrylic type resin 0.3 | Modified polyamide 0.5 | 33000 | 2 | 3 | 2 |
| Comparative Example (III)-4 | 40 | 60 | | 0 | 0 | Calcium stearate 0.6 | Acrylic type resin 0.3 | Modified polyamide 10 | 500 | 4 | 1 | 1 |
| Comparative Example (III)-5 | 30 | 70 | | 4 | 10 | Calcium stearate 0.6 | Acrylic type resin 0 | Modified polyamide 0.5 | 1700 | 3 | 2 | 5 |
| Comparative Example (III)-6 | 60 | 40 | | 4 | 10 | Calcium stearate 0.6 | Acrylic type resin 0.3 | Modified polyamide 0 | 31000 | 3 | 2 | 2 |
| Comparative Example (III)-7 | 35 | 40 | 25 | 4 | 10 | Calcium stearate 0.6 | Acrylic type resin 0.3 | Modified polyamide 0.5 | 1200 | 4 | 2 | 4 |
| Comparative Example (III)-8 | 5 | 70 | 25 | 4 | 10 | Calcium stearate 0.6 | Acrylic type resin 0.3 | Modified polyamide 0.5 | 800 | 4 | 1 | 5 |
| Comparative Example (III)-9 | 60 | 40 | | 4 | 10 | Calcium stearate 0.05 | Acrylic type resin 0.3 | Modified polyamide 0.5 | 30500 | 3 | 4 | 2 |
| Comparative Example (III)-10 | 10 | 90 | | 4 | 10 | Catcium stearale 0.6 | Acrylic type resin 0.8 | Modified polyamide 0.5 | 1600 | 3 | 2 | 5 |
| Comparative Example (III)-11 | 20 | 80 | | 4 | 10 | Calcium stearate 0.6 | Acrylic type resin 0 | Modified polyamide 0.5 | 2000 | 4 | 2 | 5 |
| Comparative Example (III)-12 | 30 | 70 | | 4 | 10 | Calcium stearate 0 | Acrylic type resin 0.3 | Modified polyamide 0.5 | 18000 | 4 | 2 | 4 |
| Comparative Example (III)-13 | 30 | 70 | | 4 | 10 | Calcium stearate 0.6 | Acrylic type resin 0.3 | Modified polyamide 0 | 17000 | 3 | 2 | 3 |
| Comparative Example (III)-14 | 5 | 95 | | 4 | 10 | Calcium stearate 0.1 | Acrylic type resin 0.3 | Modified polyamide 0.5 | 5000 | 3 | 2 | 5 |
| Comparative Example (III)-15 | 65 | 35 | | 4 | 10 | Calcium stearate 0.6 | Acrylic type resin 0.3 | Modified polyamide 3 | 20000 | 4 | 4 | 2 |

<Resistance to Printing Stain>

Using an inkjet printing press MJP 20 MX-7000 manufactured by Miyakoshi Printing Machinery Co., a 6000 m evaluation image was printed with an aqueous pigment ink under the condition of a printing speed of 150 m/min. The image to be evaluated was 3 cm×3 cm square solid patterns recorded in a single continuous row with seven colors, namely, black, cyan, magenta, yellow, and superimposed colors (red, green, blue) created by a combination of two colors out of the above three color inks except black. Printing stains present in the printed portion were visually observed, and the resistance to printing stain was evaluated according to the following criteria depending on the degree of visibility. In the present invention, if the evaluation is 3 to 5, it is assumed that the printing paper has resistance to printing stain.

5: No printing stain is recognized. Good.

4: Printing stain is almost not recognized. Almost good.

3: Printing stain is recognized slightly. However, there is no practical problem.

2: Printing stain is recognized a little.

1: Printing stain is recognized.

<Evaluation of Character Visibility>

Using an inkjet printing press MJP 20 MX-7000 manufactured by Miyakoshi Printing Machinery Co., a 6000 m evaluation image was printed with an aqueous pigment ink under the condition of a printing speed of 150 m/min. The evaluation image was an image of a character string and a reverse character string in which 5 points characters "お 微 one"

were repeatedly arranged in each single color of black, cyan, magenta and yellow. For the character visibility, the degree of visual recognition with respect to the printed character string and reverse character string was visually observed and evaluated according to the following criteria. In the present invention, if the evaluation is 3 to 5, it is assumed that the printing paper has character visibility.

5: Characters are visible.

4: Characters are generally visible.

3: Characters are visible to an understandable level although they tend to collapse.

2: Characters tend to collapse and cannot be clearly seen.

1: Characters are not visible.

<Evaluation of Scratch Resistance>

Using an inkjet printing press MJP 20 MX-7000 manufactured by Miyakoshi Printing Machinery Co., a 6000 m evaluation image was printed with an aqueous pigment ink under the condition of a printing speed of 150 m/min. The evaluation image was an image in which 10 cm×10 cm square solid image portion patterns of each single color of black, cyan, magenta, and yellow were arranged in a horizontal row without gaps. Twenty four hours after printing, scratch tests were carried out by moving cotton gauze once with the cotton gauze pressed with a load of 1000 g or 500 g. The scratch resistance was evaluated by visually observing the degree of peeling of the ink with respect to each solid portion image of black, cyan, magenta, and yellow, and evaluated according to the following criteria. In the present invention, if the evaluation is 3 to 5, it is assumed that the printing paper has scratch resistance.

5: Peeling is not observed at a load of 1000 g.

4: Slight peeling is observed at a load of 1000 g.

3: Slight peeling is observed at a load of 500 g.

2: Some peeling is observed at a load of 500 g.

1: Marked peeling is observed at a load of 500 g.

The evaluation results are shown in Table 3.

From Table 3, it is understood that Examples (III)-1 to (III)-14 corresponding to the present invention have the resistance to printing stain, character visibility and scratch resistance. On the other hand, Comparative Examples (III)-1 to (III)-15 which do not satisfy the constitution of the present invention cannot have these effects.

The invention claimed is:

1. A printing paper having a base paper, and one or more coating layer(s) arranged on at least one surface of the base paper, wherein, in the coating layer(s), an outermost coating layer positioned on an outermost side with respect to the base paper contains at least a pigment, a binder, a lubricant, a dispersant and a cationic resin, wherein the pigment in the outermost coating layer contains kaolin and calcium carbonate, a content of the kaolin and the calcium carbonate is 80 parts by mass or more based on 100 parts by mass of the pigment in the outermost coating layer, and a mass content ratio of the kaolin to the calcium carbonate in the outermost coating layer is 1:9 to 6:4, and the printing paper satisfies at least one of the following characteristics (I), (II) and (III):

(I) when an aqueous solution having a surface tension of 20 mN/m is dropped on the side having the outermost coating layer of the printing paper, a contact angle between the droplet and the outermost coating layer is between 40° and 65°;

(II) for the side having the outermost coating layer of the printing paper, a transfer amount of an aqueous solution having a surface tension of 20 mN/m at a contact time of 1 second as determined by a Bristow method is between 5.0 $ml/m^2$ and 12.0 $ml/m^2$; and (III) on the surface of the outermost coating layer of the printing paper, a maximum peak value of specular reflection light quantity of a point image is between 2,000 and 30,000.

2. The printing paper according to claim 1, wherein;

the printing paper satisfies characteristic (I).

3. The printing paper according to claim 1, wherein, the printing paper satisfies characteristic (II).

4. The printing paper according to claim 3, wherein for the side having the outermost coating layer of the printing paper, a transfer amount of an aqueous solution having a surface tension of 20 mN/m at a contact time of 0.4 second as determined by the Bristow method is further measured, and a value of (the transfer amount of an aqueous solution having a surface tension of 20 mN/m at a contact time of 1 second as determined by the Bristow method)—(the transfer amount of an aqueous solution having a surface tension of 20 mN/m at a contact time of 0.4 second as determined by the Bristow method) is 0.5 $ml/m^2$ or more and 2.5 $ml/m^2$ or less.

5. The printing paper according to claim 1, the printing paper satisfies characteristic (III).

* * * * *